US006298518B1

(12) United States Patent
Umbrell

(10) Patent No.: US 6,298,518 B1
(45) **Date of Patent: *Oct. 9, 2001**

(54) HEAT DISSIPATING BUFFING PAD

(76) Inventor: Richard T. Umbrell, 215 N. Lucia Ave., Redondo Beach, CA (US) 90277

( * ) Notice: Subject to any disclaimer, the term of this patent is extended or adjusted under 35 U.S.C. 154(b) by 0 days.

This patent is subject to a terminal disclaimer.

(21) Appl. No.: 09/060,172

(22) Filed: Apr. 14, 1998

(51) Int. Cl.[7] ..... B24D 13/14

(52) U.S. Cl. ..... 15/230.1; 15/230; 15/230.19; 451/449

(58) Field of Search ..... 15/230.1, 230.19, 15/230.16, 230, 52, 97.1, 98, 244.1; 451/449, 488, 515, 490

(56) References Cited

U.S. PATENT DOCUMENTS

| | | | | |
|---|---|---|---|---|
| Re. 35,021 | | 8/1995 | Englund et al. | 15/230.16 |
| 577,860 | | 2/1897 | Keighley . | |
| 816,461 | | 3/1906 | Gorton . | |
| 1,525,225 | | 2/1925 | Chase . | |
| 1,877,527 | | 9/1932 | Moran . | |
| 1,953,983 | | 4/1934 | Benner | 51/280 |
| 2,242,877 | | 5/1941 | Albertson | 51/293 |
| 2,263,883 | | 11/1941 | Livermont | 15/230 |
| 2,269,721 | | 1/1942 | Johnson | 15/130 |
| 2,319,873 | | 5/1943 | Linz | 15/244 |
| 2,347,244 | | 4/1944 | Colt et al. | 51/294 |
| 2,501,524 | | 3/1950 | Jones | 51/197 |
| 2,650,385 | * | 9/1953 | Michel | 15/230.1 |
| 2,653,428 | | 9/1953 | Fuller | 51/195 |
| 2,804,733 | | 9/1957 | Hurst | 51/206 |
| 2,835,911 | | 5/1958 | Mahmarian | 15/131 |
| 2,838,890 | | 6/1958 | McIntyre | 51/185 |
| 3,072,942 | * | 1/1963 | Richardson | 15/230.19 |
| 3,100,905 | | 8/1963 | Salick | 15/235 |
| 3,171,820 | | 3/1965 | Volz | 260/2.5 |
| 3,177,820 | | 4/1965 | Pazar et al. | 107/14 |
| 3,196,586 | | 7/1965 | Brown et al. | 51/394 |

(List continued on next page.)

FOREIGN PATENT DOCUMENTS

| | | | | |
|---|---|---|---|---|
| 1106611 | | 11/1981 | (CA) . | |
| 638967 | | 10/1983 | (CH) . | |
| 1502347 | | 7/1969 | (DE) . | |
| 3043044 | | 6/1982 | (DE) . | |
| 3201825 | | 7/1983 | (DE) . | |
| 0004454 | | 10/1979 | (EP) . | |
| 0095015 | | 11/1983 | (EP) . | |
| 0196832 | | 10/1986 | (EP) . | |
| 0379361 | | 7/1990 | (EP) . | |
| 1254735 | | 1/1961 | (FR) . | |
| 7898 | * | 3/1909 | (GB) | 451/490 |
| 313850 | | 2/1930 | (GB) . | |
| 416055 | * | 9/1934 | (GB) | 15/98 |
| 671501 | | 5/1952 | (GB) . | |
| 990142 | | 4/1965 | (GB) . | |

(List continued on next page.)

OTHER PUBLICATIONS

"Buff and Shine Performance Products" brochure (8 Pages).

*Primary Examiner*—Gary K. Graham
(74) *Attorney, Agent, or Firm*—O'Melveny & Meyers LLP

(57) ABSTRACT

A buffing pad assembly is provided for buffing, polishing or otherwise finishing a painted surface. The buffing pad assembly includes a rigid backing mount, a back-up pad affixed to the backing mount, and a buffing pad removably attached to the back-up pad by way of fastening material provided on the back-up pad and the buffing pad. The buffing pad has a number of channels extending completely through the pad to facilitate dissipation of heat generated by friction during use of the buffing pad. The back-up pad and the fastening material are designed to accommodate the heat dissipation channels in the buffing pad so that the channels are substantially unobstructed. Additionally, a centering system is provided on the buffing pad assembly to facilitate alignment of the buffing pad during use.

22 Claims, 5 Drawing Sheets

U.S. PATENT DOCUMENTS

| | | | | |
|---|---|---|---|---|
| 3,302,232 | | 2/1967 | Wasiloff et al. | 15/230.17 |
| 3,324,608 | | 6/1967 | Hoenig | 51/395 |
| 3,341,984 | * | 9/1967 | Sickle et al. | 451/490 |
| 3,346,904 | | 10/1967 | Armstrong | 15/230.12 |
| 3,418,675 | | 12/1968 | Meguiar et al. | 15/230 |
| 3,468,079 | | 9/1969 | Kaufman | 51/378 |
| 3,495,362 | | 2/1970 | Hillenbrand | 51/395 |
| 3,498,010 | | 3/1970 | Hagihara | 51/395 |
| 3,499,250 | | 3/1970 | Jensen et al. | 51/109 |
| 3,512,204 | | 5/1970 | Jagiel | 15/230.16 |
| 3,529,385 | | 9/1970 | Stein | 51/394 |
| 3,537,121 | | 11/1970 | McAvoy | 15/230.12 |
| 3,597,887 | | 8/1971 | Hall, Jr. | 51/395 |
| 3,655,444 | | 4/1972 | Young | 134/6 |
| 3,757,378 | | 9/1973 | Wakefield | 15/230.19 |
| 3,793,665 | * | 2/1974 | Thielen | 15/98 |
| 3,823,516 | | 7/1974 | Christian | 51/358 |
| 3,844,072 | | 10/1974 | Haigh et al. | 51/378 |
| 3,866,361 | | 2/1975 | Mauck | 51/358 |
| 3,869,263 | | 3/1975 | Greenspan | 51/209 R |
| 3,918,220 | | 11/1975 | Jury et al. | 51/328 |
| 3,981,106 | | 9/1976 | Gallo | 51/358 |
| 4,055,029 | | 10/1977 | Kalbow | 51/395 |
| 4,111,666 | | 9/1978 | Kalbow | 51/295 |
| 4,114,225 | | 9/1978 | Malish et al. | 15/230.17 |
| 4,182,616 | | 1/1980 | Gadbois et al. | 51/295 |
| 4,263,755 | | 4/1981 | Globus | 51/358 |
| 4,291,508 | | 9/1981 | Prunier | 51/395 |
| 4,343,112 | | 8/1982 | Jarrett | 51/131.3 |
| 4,502,174 | | 3/1985 | Rones | 15/98 |
| 4,576,612 | | 3/1986 | Shukla et al. | 51/295 |
| 4,609,481 | | 9/1986 | Tsubouchi et al. | 252/73 |
| 4,609,581 | | 9/1986 | Ott | 428/100 |
| 4,692,958 | | 9/1987 | McMakin | 15/230.12 |
| 4,715,150 | | 12/1987 | Takeuchi et al. | 51/395 |
| 4,747,176 | | 5/1988 | Parks | 15/230.16 |
| 4,788,798 | | 12/1988 | DeFranco et al. | 51/406 |
| 4,841,680 | | 6/1989 | Hoffstein et al. | 51/283 R |
| 4,907,313 | | 3/1990 | Roeker et al. | 15/98 |
| 4,930,179 | | 6/1990 | Wright et al. | 15/230.11 |
| 4,962,562 | | 10/1990 | Englund et al. | 15/230.16 |
| 4,969,226 | | 11/1990 | Seville | 15/244.4 |
| 4,989,304 | | 2/1991 | Sonefors | 29/78 |
| 5,003,659 | | 4/1991 | Paepke | 15/209 D |
| 5,007,128 | | 4/1991 | Englund et al. | 15/230.16 |
| 5,114,255 | | 5/1992 | Villarreal | 401/45 |
| 5,123,139 | | 6/1992 | Leppert et al. | 15/230.17 |
| 5,138,735 | | 8/1992 | Kusz et al. | 15/97.1 |
| 5,150,546 | | 9/1992 | Tucker | 51/170 T |
| 5,172,448 | | 12/1992 | Kitahata | 15/230 |
| 5,174,795 | | 12/1992 | Wiand | 51/295 |
| 5,214,820 | | 6/1993 | Shumway et al. | 15/118 |
| 5,249,329 | | 10/1993 | Arnold | 15/230 |
| 5,257,478 | | 11/1993 | Hyde et al. | 51/131.3 |
| 5,309,681 | | 5/1994 | Cheney et al. | 51/170 R |
| 5,309,682 | * | 5/1994 | Gutknecht et al. | 451/490 |
| 5,311,634 | | 5/1994 | Andros | 15/97.1 |
| 5,390,449 | | 2/1995 | Hilton | 451/526 |
| 5,396,737 | | 3/1995 | Englund et al. . | |
| 5,527,215 | | 6/1996 | Rubino et al. | 451/527 |
| 6,105,197 | * | 8/2000 | Umbrell | 15/230 |

FOREIGN PATENT DOCUMENTS

| | | | | |
|---|---|---|---|---|
| 2207626 | * | 2/1989 | (GB) | 451/490 |
| 2043501 | | 10/1990 | (GB) . | |
| 479639 | * | 4/1953 | (IT) | 15/98 |
| 5015764 | | 2/1975 | (JP) . | |
| 584361 | | 1/1983 | (JP) . | |
| 3130366 | | 12/1991 | (JP) . | |
| 42565 | | 1/1992 | (JP) . | |
| 419766 | | 2/1992 | (JP) . | |
| 460662 | | 5/1992 | (JP) . | |
| 3032962 | | 1/1997 | (JP) . | |

* cited by examiner

HEAT DISSIPATING BUFFING PAD

FIELD OF THE INVENTION

The present invention relates to an improved buffing pad assembly particularly adapted for use in polishing, buffing or otherwise finishing painted surfaces, such as the painted sheet metal bodies of automotive vehicles.

BACKGROUND OF THE INVENTION

The use of soft pads for buffing, polishing or otherwise finishing the painted surfaces of automobiles is well known. Depending on the finish desired, the buffing or polishing may require several steps, and the use of multiple finishing compounds. In order to perform these steps, the soft buffing pads are removably attached to a buffing machine, such as a motorized buffer or polisher. The buffing machines typically include a generally disk-shaped backing mount to which the buffing pad is attached. The backing mount is rotationally driven by the motor of the buffing machine, causing the attached buffing pad to rotate. As the buffing pad rotates, the finishing compounds help smooth out irregularities in the painted surfaces being finished, producing a sheer, glossy shine on the automobile.

A number of different types of buffing pads may be used to create the desired finish. For example, wool or other fabric pads are sometimes employed, generally in the early stages of the finishing process. During the later stages of finishing a painted surface, foam pads are typically used. The resiliency of foam provides a very soft surface so as to avoid excessive pressure on the finishing compound against the surface. However, due to the speed at which the buffing pad is being rotated during operation, conventional buffing pads produce a significant amount of heat due to friction between the pad and the surface to be finished. Prolonged use of conventional buffing pads, therefore, may result in the buildup of frictional heat sufficient to damage the surfaces being finished (e.g., burn the paint on the surface).

For example, many conventional buffing pads are fabricated having a convoluted or "egg crate" polishing surface in which projecting portions of the convoluted surface are separated from each other by recesses between the projections. Frictional heat generated at the convoluted surface of these buffing pads remains trapped within the recesses of the buffing pad. Moreover, the convoluted polishing surfaces of these buffing pads tend to wear down with moderate use, such that the danger of harmful thermal buildup at the polishing surface may increase over the life of the buffing pad. Additionally, the projecting portions of these convoluted pads tend to wear down more rapidly than the rest of the pad, and consequently, the convoluted pads become nearly flat after prolonged use.

Another problem often experienced during the use of conventional buffing pads is the tendency of such pads to bounce or skip across the surface to be finished when rotated at high speeds. This produces not only an uneven finish on the surface to be polished, but also significant operator discomfort as a result of trying to control the buffing pad.

Additionally, various attempts have been made at providing a means for properly aligning conventional buffing pads with the backing mount (See U.S. Pat. No. 5,123,139 to Leppert et al.). Centering the relative components of the buffing pad assembly is important as an off-centered buffing pad may create a balancing problem, causing the buffing pad to wobble. The resulting vibration produced by an off-centered buffing pad may result in an inferior buffing or finishing job. Moreover, attempts to overcome the vibration produced by an off-centered buffing pad can easily fatigue the operator of the buffing machine.

Leppert et al. discloses the use a frustro-conical centering post on the buffing pad. In order to help secure the centering post to the buffing pad, the centering post disclosed in Leppert et al. is located underneath a layer of fastening material. As a result, the attachment between the fastening material and buffing pad is relatively weak at the interface of the centering post and the fastening material. Moreover, it is often difficult to secure the fastening material to the centering post. Therefore, in the centering systems such as the one disclosed by Leppert et al., the fastening material is more prone to separate from the buffing pad after moderate use.

Consequently, a need exists for an improved buffing pad assembly for use in polishing, buffing or otherwise finishing painted surfaces.

SUMMARY OF THE INVENTION

The present invention, therefore, provides an improved buffing pad assembly for use in polishing, buffing or otherwise finishing painted surfaces.

In a presently preferred embodiment, the buffing pad assembly includes a backing mount adapted to secure the buffing pad assembly to a buffing machine; a back-up pad, having an upper and lower surface, secured at its upper surface to the backing mount; a buffing pad, having a front buffing surface and a rear mounting surface, removably attached at its rear mounting surface to the lower surface of the back-up pad; and means for dissipating heat generated at the front buffing surface of the buffing pad during use of the buffing pad assembly. A layer of fastening material may be provided on the rear mounting surface of the buffing pad and the lower surface of the back-up pad for removably attaching the two components.

By providing means for dissipating the heat generated at the front buffing surface, the present invention reduces the risk of damaging the painted surface associated with prolonged use at high speeds of conventional buffing pads.

In one embodiment, a plurality of apertures are provided in the buffing pad for dissipating the frictional heat generated during use. The apertures extend through the buffing pad from the front buffing surface to the rear mounting surface. In addition to improving the dissipation of heat, the plurality of apertures also reduce the friction between the painted surface and the front buffing surface, reducing the amount of heat generated during use.

To allow heat to dissipate efficiently, the back-up pad and layers of fastening material are preferably configured to accommodate means for dissipating heat in the buffing pad. For example, these components may be non-circular configurations to accommodate the plurality of apertures in the buffing pad. In addition to improving the dissipation of heat, providing non-circular back-up pads and layers of fastening material improves the dissipation of heat and decreases the likelihood of the buffing pad grabbing, skipping or jumping during use by allowing the relief for the buffing pad through the application of varying pressures on different regions of the pad.

Additionally, the buffing pad assembly is provided with a centering system for aligning the buffing pad on the back-up pad. In a presently preferred embodiment, the centering system includes an axially aligned centering post projecting from and mounted on a top surface of the layer of fastening material on the rear mounting surface of the buffing pad, and an axially aligned socket defined in the back-up pad. Positioning the centering post above the layer of fastening material on the rear mounting surface of the buffing pad allows for more secure attachment of the fastening material to the buffing pad. As a result, the fastening material is less likely to separate from the buffing pad during prolonged use. Additionally, this allows for easier manufacturing of the buffing pad assembly.

BRIEF DESCRIPTION OF THE DRAWINGS

These and other features and advantages of the present invention will be appreciated as the same become better understood by reference to the following Detailed Description when considered in connection with the accompanying drawings, wherein.

DETAILED DESCRIPTION OF THE INVENTION

Figure 1:
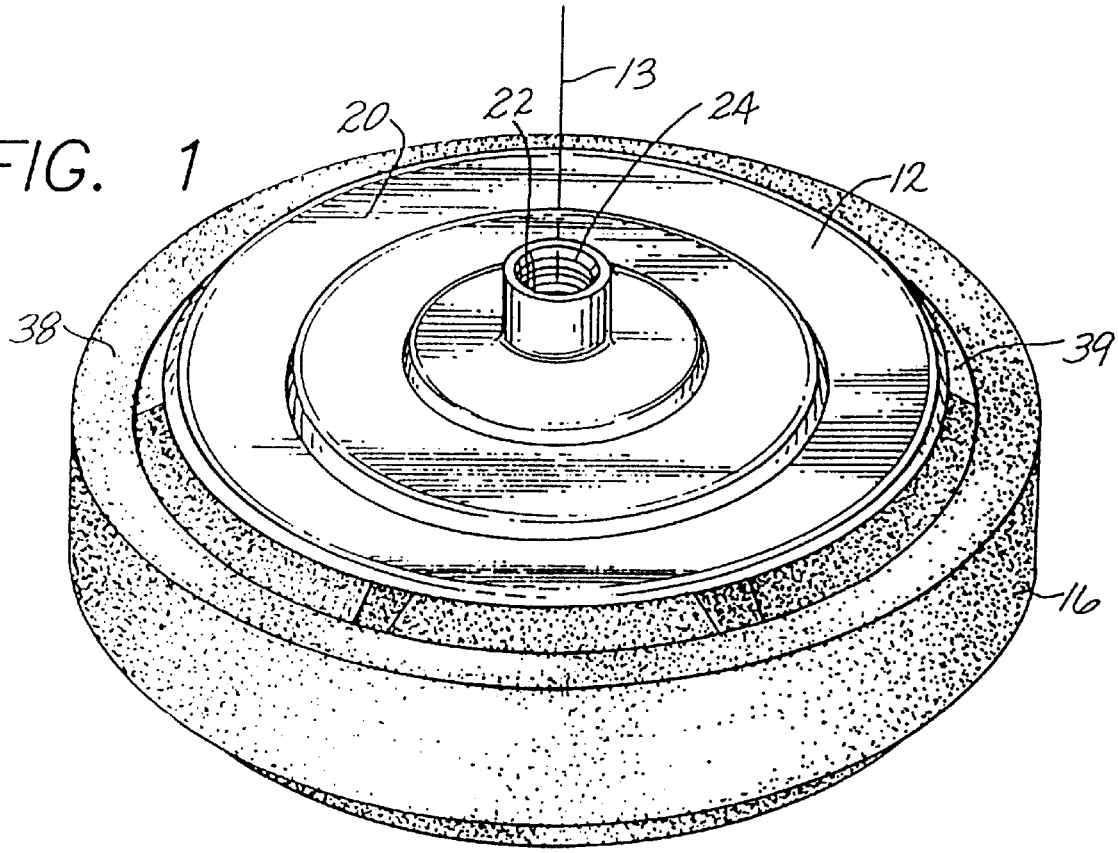
FIG. 1 is a perspective view of the buffing pad assembly according to the present invention, wherein a back-up pad is mounted to a buffing pad.
Figure 2:
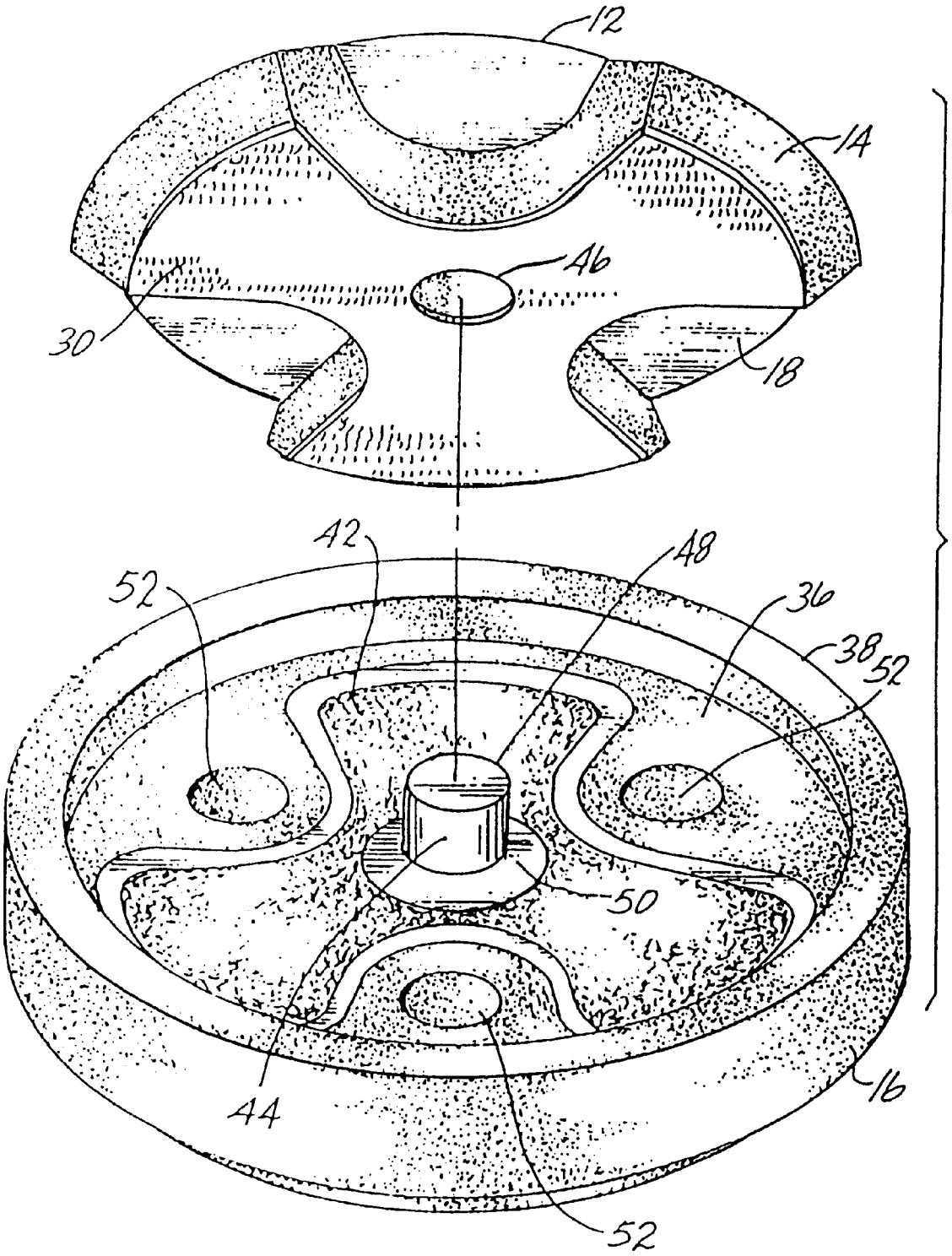
FIG. 2 is an exploded view of the buffing pad assembly of FIG. 1.

Referring now in detail to the drawings, a presently preferred embodiment of the buffing pad assembly is illustrated in FIGS. 1 and 2. As seen therein, the buffing pad assembly generally includes a backing mount 12 having a driving axis 13, a back-up pad 14 secured to the backing mount, and a buffing pad 16 removably attached to the back-up pad.

Figure 5:
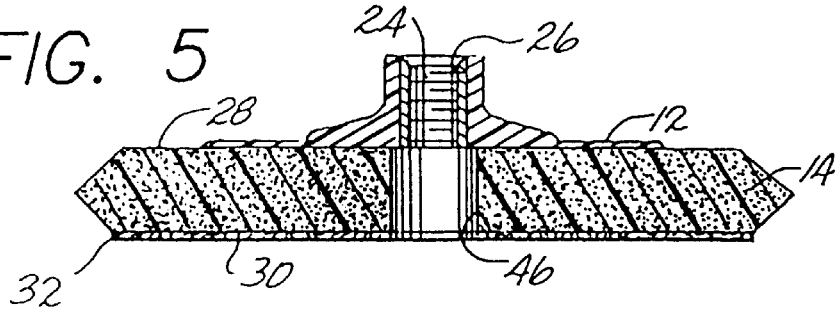
FIG. 5 is a side cross-sectional view of the back-pad taken along line 5—5 of FIG. 4.

The backing mount 12 (FIGS. 4 and 5) is relatively rigid disk, preferably formed of a plastic such as acrylonitrile butadiene sytrene (ABS), having a front surface 18 for receiving the back-up pad 14, and a rear surface 20 adapted to engage a buffing machine (not shown). The rear surface of the backing mount includes an axially aligned hub 22, preferably integrally formed with the backing mount. Hub 22 includes an internally threaded insert 24 secured therein, inside a bore 26, for threadably engaging the backing mount to a rotating drive shaft (not shown) of an electric motor of the buffing machine.

While it is important to have a relatively stiff backing mount to provide the necessary rigidity and structural support to properly distribute the forces applied along driving axis 13 during buffing, there is a risk that the backing mount may contact the surface to be finished. This risk increases at the later stages of the useful life of the buffing pad when the pad has been worn down or compressed over a period of time. Since such contact would very likely damage the surface to be finished, the back-up pad 14 is secured to the front surface 18 of the backing mount, at an upper surface 28 of the back-up pad, to isolate the backing mount from the buffing pad. In order to properly isolate the backing mount from the buffing pad, the back-up pad is preferably made of a material with a rigidity in between that of the buffing pad and the backing mount. In a presently preferred embodiment, the back-up pad is formed of a closed-cell polyurethane foam.

A layer of fastening material 30 is provided on a lower surface 32 of the back-up pad, opposite the backing mount, for removably attaching the buffing pad to the back-up mount. In a presently preferred embodiment, the fastening material 30 is a layer of hook material marketed under the name VELCRO, by Velcro U.S.A. The remaining aspects of the back-up pad will be discussed in more detail below, in conjunction with some of the other features of the buffing pad assembly.

In the embodiment illustrated in FIGS. 1 and 2, the buffing pad 16 is a substantially cylindrical disk 34, preferably formed of reticulated polyurethane foam. The buffing pad 16 has a generally planar rear mounting surface 36, surrounded by a raised, annular centering lip 38, for receiving the back-up pad. Preferably, an annular gap 39 exists between the back-up pad and the centering lip when the back-up pad is attached to the buffing pad. The gap 39 provides for a more flexible buffing pad at its outer edges, and helps to isolate the more rigid back-up pad from the painted surface.

Figure 6:
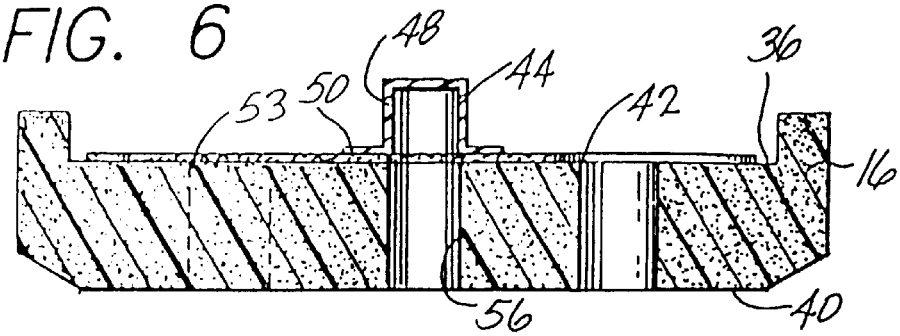
FIG. 6 is a side cross-sectional view of the buffing pad taken along line 6—6 of FIG. 3.

The buffing pad (FIGS. 3 and 6) also includes a front buffing surface 40, opposite and parallel to the rear mounting surface of the buffing pad. A layer of fastening material 42 is affixed to the rear surface 36 of the buffing pad for securing the buffing pad to the back-up pad and the backing mount. The fastening material 42 on the rear surface of the buffing pad engages the fastening material 30 on the lower surface of the back-up pad to removably attach the buffing pad to the back-up mount. In a presently preferred embodiment, the fastening material 42 is loop material marketed under the name VELCRO, by Velcro U.S.A.

The buffing pad assembly also includes a centering system adapted to facilitate proper alignment of the buffing pad 16 relative to the backing mount 12. The centering system includes an axially aligned male centering post 44 on the buffing pad. Specifically, the centering post is affixed to a top surface of the fastening material 42 on the rear surface of the buffing pad, and projects outwardly from the buffing pad 16. The back-up pad 14 includes a matching axially aligned socket 46 for receiving the centering post 44. To accommodate the centering post, an aperture may be included in the layer of fastening material on the lower surface 32 of the back-up pad.

The centering post 44 includes a hollow cylinder 48 projecting from a flanged end 50. The flanged end 50 of the centering post assists in securing the centering post 44 to the fastening material 42 on the rear surface, and rests on the fastening material 42. The centering post may be made from any suitable material, for example polyvinyl chloride (PVC) plastic. Additionally, the respective dimensions of the centering post and socket are preferably such that the centering post is snugly received within the socket when the buffing pad is attached to the back-up pad.

In a presently preferred embodiment, the socket 46 extends entirely through the back-up pad 14 , from its lower surface 32 to its upper surface 28. To facilitate the centering of the back-up pad 14 on the backing mount 12 during manufacture of the buffing pad assembly, the bore 26 of the hub preferably extends entirely through the backing mount 12, so that it is possible to visually align the socket of the back-up pad with the bore of the backing mount.

Figure 3:
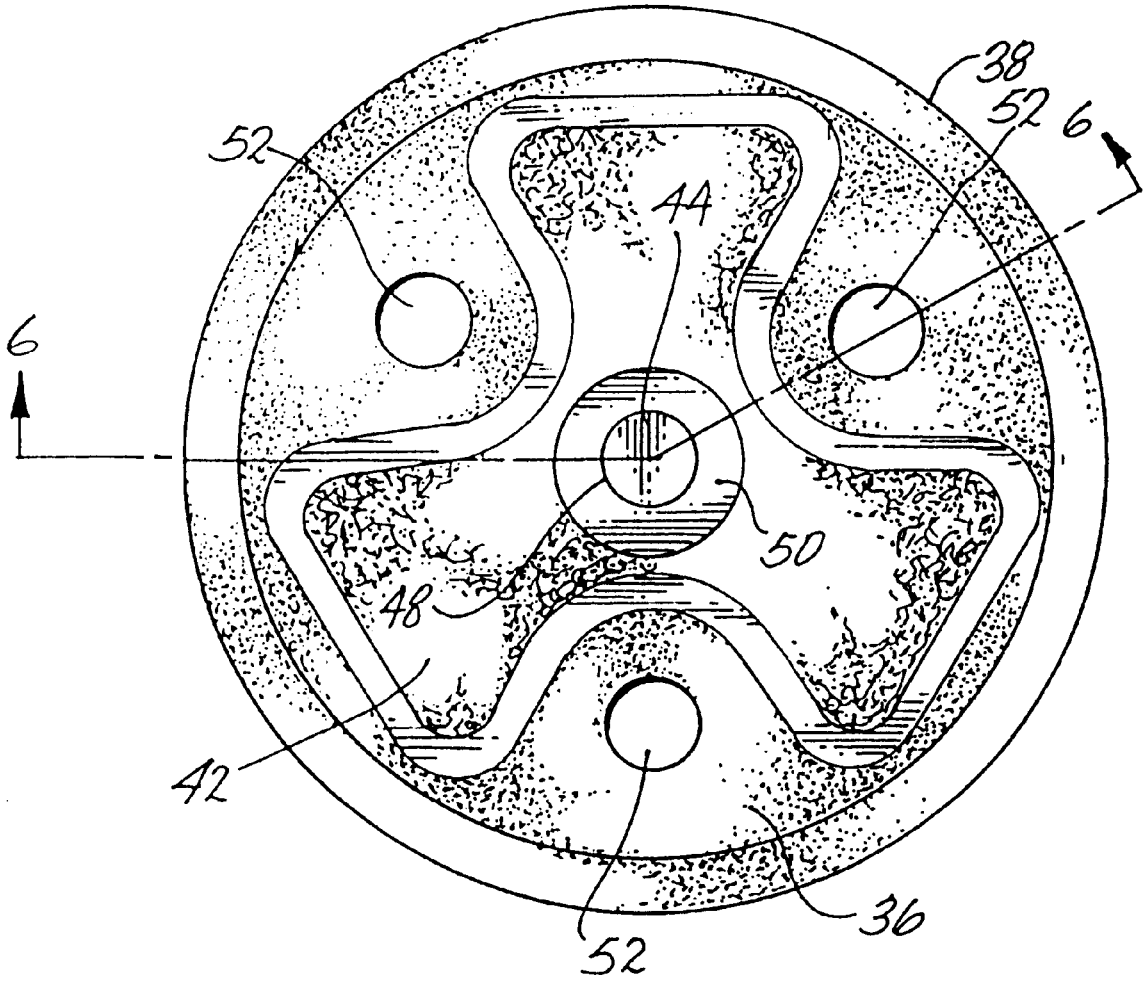
FIG. 3 is a top elevation view of the buffing pad of FIG. 1.

As can be seen from FIG. 3, the buffing pad 16 includes a plurality of apertures 52, or heat dissipation channels, extending completely through the pad. The apertures 52 extend from the front buffing surface 40 of the pad to the rear mounting surface 36 of the pad, and facilitate the dissipation of heat generated at the front buffing surface of the pad during use. At the same time, the apertures may also reduce the friction between the buffing pad and the surface to be finished.

The effectiveness of the apertures 52 in reducing friction and dissipating heat will depend on a number of factors, including the size and shape of the apertures, the number of apertures within the buffing pad, and the configuration of the apertures. In a presently preferred embodiment shown in FIG. 3, three cylindrical apertures extend parallel to the driving axis of the buffing pad assembly. The cylindrical apertures are preferably of uniform cross section throughout their respective lengths, and more particularly, about three-quarters of an inch in diameter. Additionally, the three cylindrical apertures are preferably arranged at a uniform radially spaced distance from the driving axis 13, at uniform intervals of angular separation from one another.

The ability of the apertures 52 to effectively dissipate heat from the front surface of the buffing pad may be hampered by the presence of the backing pad or fastening material directly over an upper end 53 the apertures at the rear mounting surface of the buffing pad. Therefore, because conventional buffing pad assemblies typically include circular back-up pads and circular layers of fastening material, it may be advantageous to provide matching apertures in the back-up pad and the layers of fastening material to accommodate the apertures in the buffing pad. Providing these matching apertures ensures that the upper end of the heat dissipation channels will be unobstructed.

Alternatively, it may be desirable to accommodate the apertures in the buffing pad through the use a non-circular back-up pad 14, a non-circular layer of fastening material 30 on the lower surface of the back-up pad, a non-circular layer of fastening material 42 on the rear mounting surface of the buffing pad, or any combination thereof. For example, as can be best seen in FIG. 2, a non-circular back-up pad 14 is used in a presently preferred embodiment of the buffing pad assembly. The precise configuration of the non-circular back-up may vary, so long as the overall configuration is capable of accommodating the apertures 52 in the buffing pad, while still isolating the backing mount 12 from the buffing pad 16. Generally speaking, the configuration of the back-up pad 14 will dictate, in part, the possible configurations available for the layer of fastening material 30 on the lower surface of the back-up pad.

One of the significant advantages associated with the use of a non-circular back-up pad is that it breaks up the friction generated at the front buffing surface during finishing or buffing. When flat buffing pads are used with conventional back-up pads, the level of pressure applied to, and thus the friction generated at, the front buffing surface of the buffing pad is relatively constant at all sections of the front buffing surface. However, using a non-circular back-up pad produces a variable friction profile at the front buffing surface by varying the pressure applied to different sections of the buffing pad. Specifically, relatively high levels of friction are generated in the sections of the buffing pad directly beneath the back-up pad, and relatively low levels of friction are generated in the sections of the buffing pad that are not directly beneath the back-up pad. The variable friction profile improves the overall performance of the buffing pad assembly in a number of different ways. First, it provides relative relief for certain sections the pad, and therefore reduces the grabbing, skipping or jumping of the pad during use, which has been a common problem associated with conventional back-up pads. Second, it reduces the total friction generated at the front buffing surface, therefore, reducing the overall frictional heat generated at the front buffing surface.

Figure 4:
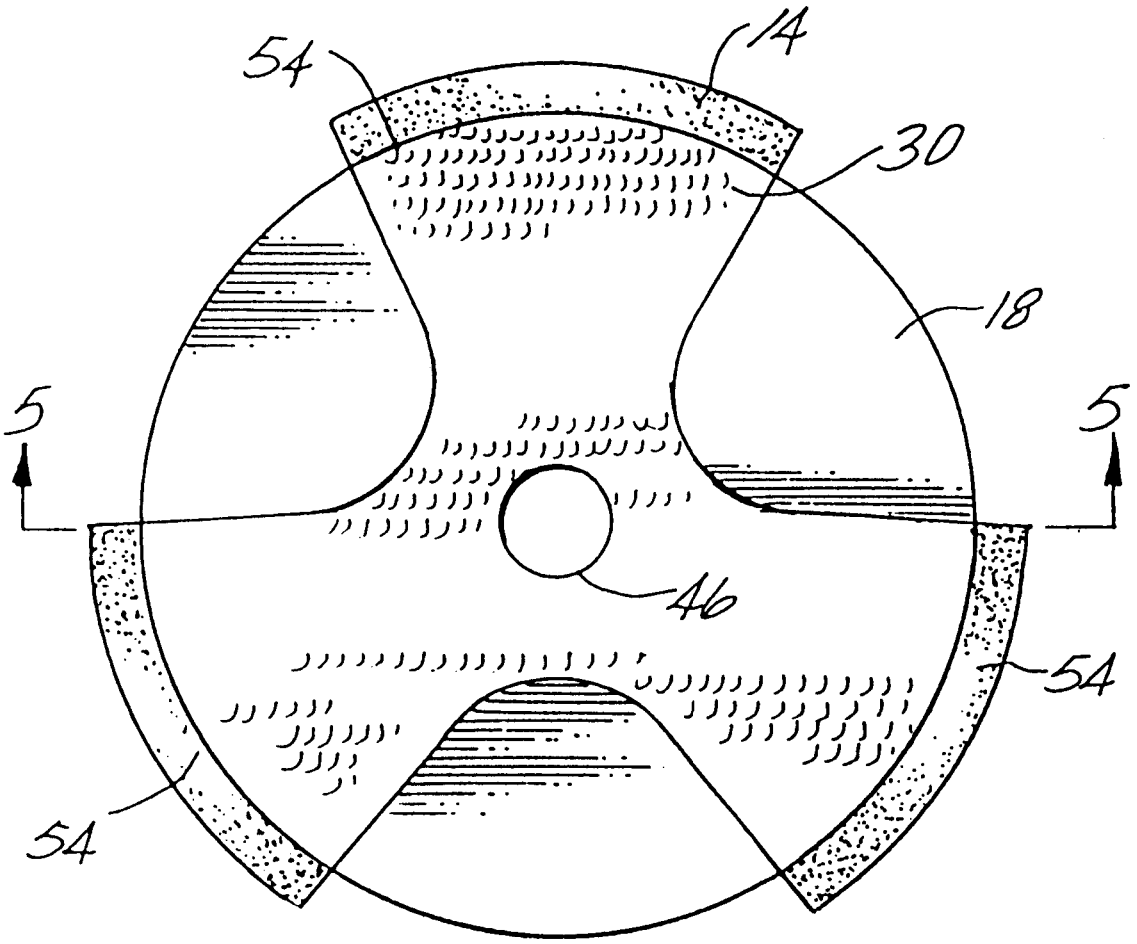
FIG. 4 is a bottom elevation view of the back-up pad of FIG. 1.
Figure 7:
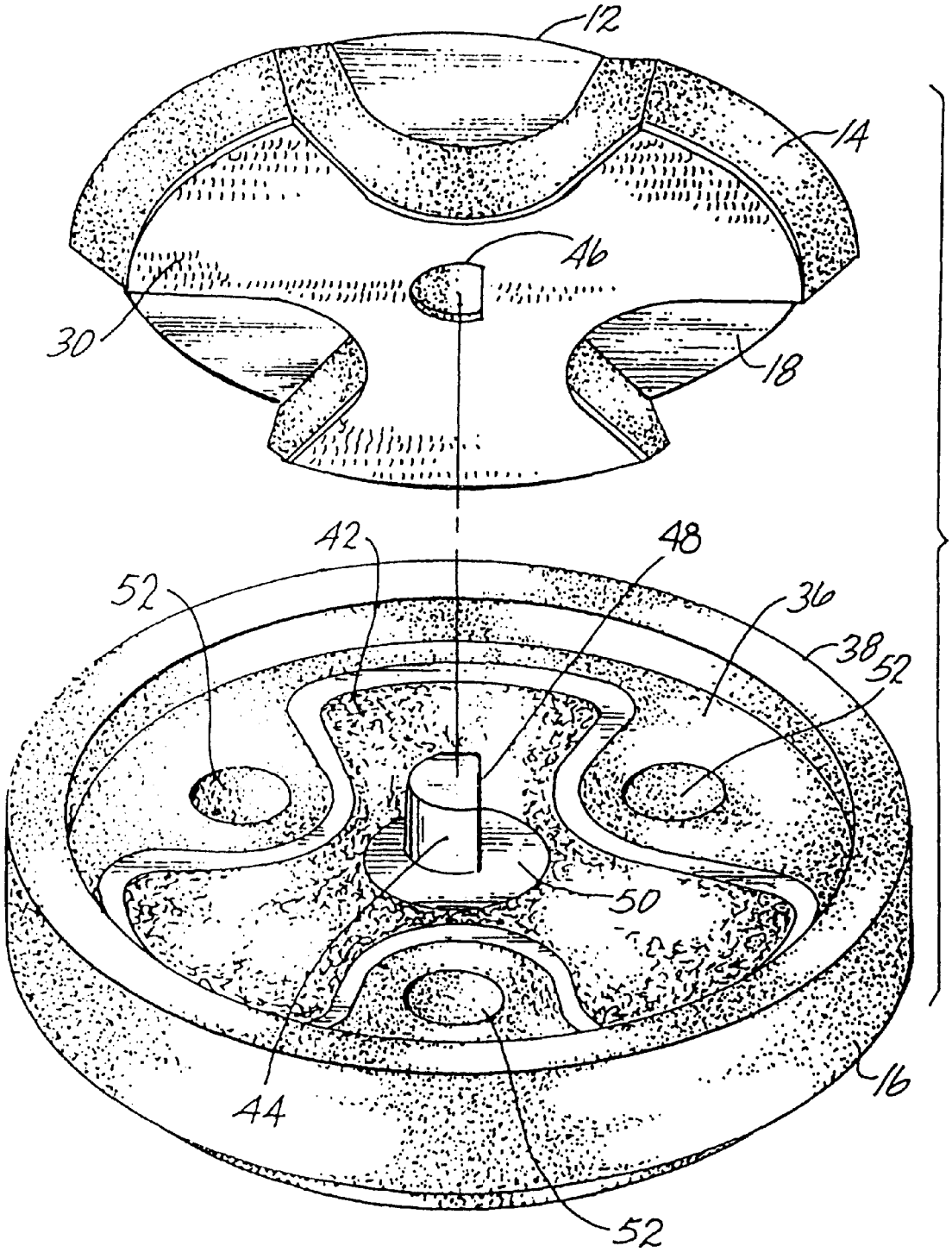
FIG. 7 is an exploded view of the buffing pad assembly according to FIG. 1 wherein the centering system includes means for automatically aligning the layer of fastening material on the back-up pad with the layer of fastening material on the buffing pad.

The back-up pad in FIG. 4 has three symmetrical sections 54 extending radially from the socket 46 in the back-up pad in a configuration that generally resembles a three-leaf clover. The distance between adjacent sections is such that the back-up pad 14 is not directly over any of the three cylindrical apertures in the buffing pad, so as not to substantially interfere with the dissipation of heat from the buffing pad. In this embodiment, the configuration of the layer of fastening material 30 on the lower surface of the back-up pad corresponds directly to the configuration of the back-up pad 14 itself.

Additionally, it may be desirable to provide a non-circular layer of fastening material 42 on the rear mounting surface of the buffing pad. In a presently preferred embodiment, the configuration of the layer of fastening material 42 on the rear mounting surface of the buffing pad corresponds directly to the configurations of the back-up pad 14, and the layer of fastening material 30 on the lower surface of the back-up pad. However, it should be noted that it is not necessary that any of these configuration correspond directly to one another, so long as the apertures in the buffing pad are properly accommodated.

If desired, another aperture 56 may be provided in the buffing pad 16, centered upon the driving axis 13. As discussed above with regard to the backing mount and the back-up pad, it may be desirable to provide a means for facilitating the centering the respective components of the buffing pad assembly during manufacture of the assembly. Since the centering aperture 56 extends completely through the buffing pad 16, it will facilitate the centering of the layer of fastening material 42 on the rear surface of the buffing pad, particularly if a matching aperture (not shown) is provided in the fastening material 42. These centering apertures will also facilitate the centering of the post 44 on the buffing pad, as the post may be visually aligned with the centering apertures during manufacture.

Where both layers of fastening material 30, 42 are non-circular, it may be desirable to provide a means for aligning the layers of fastening material with one another. Such means may include providing matching notches 60 on the centering post and in the bore, so that proper alignment of the notches on the centering system produces proper alignment of the layers of fastening material. Other suitable means for aligning the layers of fastening material may be used in place, or in combination with, the means described above.

The buffing pad provided herein may be used with a variety of finishing compounds to produce the desired finish. The centering system allows for quick, easy and secure attachment of the buffing pad to the back-up pad. Once the finishing compounds have been applied on the painted surface to be finished, the rotating buffing pad may be moved along the surface. It should be noted that the finishing compounds may be applied directly to the painted surface, or alternatively, to the front buffing surface of the pad which will be brought into contact with the painted surface. The front buffing surface of the rotating pad begins to work the finishing compounds into the surface. If needed, the operator may apply a force perpendicular to the axis of rotation of the buffing pad to improve the effectiveness of the finishing compounds. The force applied to the backing mount will compress the buffing pad and help work the finishing compound into the surface. As already noted, however, the heat generated by the friction between the buffing pad and surface will not cause any damage to the painted surface because of the heat dissipation means in the buffing pad provided by the present invention.

While various embodiments of this invention have been shown and described, it would be apparent to those skilled in the art that many more modifications are possible without departing from the inventive concept herein. For example, any number of different configurations for the heat dissipation channels may be used to remove heat from the buffing surface of the pad. It is, therefore, to be understood that within the scope of the appended claims, this invention may be practiced otherwise than as specifically described.

What is claimed is:

1. A buffing pad assembly adapted for use with a buffing machine, the buffing pad assembly comprising:

a backing mount adapted to secure the buffing pad assembly to the buffing machine;

a back-up pad, having an upper and lower surface, secured at its upper surface to the backing mount;

a buffing pad, having a front buffing surface and a rear mounting surface surrounded by a raised annular centering lip, wherein the buffing pad is removably attached at its rear mounting surface to the lower surface of the back-up pad; and means for dissipating heat generated at the front buffing surface of the buffing pad during use of the buffing pad assembly, wherein the means for dissipating heat comprises a plurality of apertures extending through the buffing pad from the front buffing surface to the rear mounting surface, and wherein an upper end of the plurality of apertures is substantially unobstructed.

2. The buffing pad assembly according to claim 1, wherein the back-up pad has a non-circular configuration.

3. The buffing pad assembly according to claim 1, further comprising a layer of fastening material on the rear mounting surface of the buffing pad engageable with a layer of fastening material on the lower surface of the back-up pad.

4. A buffing pad assembly adapted for use with a buffing machine, the buffing pad assembly comprising:

a backing mount adapted to secure the buffing pad assembly to the buffing machine;

a back-up pad, having an upper and lower surface, secured at its upper surface to the backing mount;

a buffing pad, having a front buffing surface and a rear mounting surface surrounded by a raised annular centering lip, wherein the buffing pad is removably attached at its rear mounting surface to the lower surface of the back-up pad; and means for dissipating heat generated at the front buffing surface of the buffing pad during use of the buffing pad assembly, wherein the means for dissipating heat comprises a plurality of apertures extending through the buffing pad from the front buffing surface to the rear mounting surface, and wherein the back-up pad has a configuration with sections of the back-up pad having gaps to accommodate the plurality of apertures in the buffing pad.

5. The buffing pad assembly according to claim 4 wherein the back-up pad comprises a plurality of substantially symmetrical sections extending radially from a driving axis of the buffing pad assembly.

6. The buffing pad assembly according to claim 5 wherein the layer of fastening material on the rear mounting surface of the buffing pad comprises a plurality of substantially symmetrical sections extending radially from the driving axis of the buffing pad assembly.

7. The buffing pad assembly according to claim 6 wherein the back-up pad comprises three substantially symmetrical sections extending radially from the driving axis of the buffing pad assembly and wherein the configuration of the layer of fastening material on the rear mounting surface matches the configuration of the back-up pad.

8. The buffing pad assembly according to claim 4, wherein the back-up pad has a non-circular configuration.

9. The buffing pad assembly according to claim 4, further comprising a layer of fastening material on the rear mounting surface of the buffing pad engageable with a layer of fastening material on the lower surface of the back-up pad.

10. A buffing pad assembly adapted for use with a buffing machine, the buffing pad assembly comprising:

a backing mount adapted to secure the buffing pad assembly to the buffing machine;

a back-up pad with a non-circular configuration having an upper and lower surface, said back tip pad being secured at its upper surface to the backing mount;

a buffing pad, having a front buffing surface and a rear mounting surface removably attached at its rear mounting surface to the lower surface of the back-up pad said buffing pad including an axially aligned centering aperture extending from the front buffing surface to the rear mounting surface, and wherein said buffing pad has on its rear surface a layer of fastening material with a configuration adapted to accommodate apertures in the buffing pad itself, and wherein the layer of fastening material on the rear mounting surface of the buffing pad includes an axially aligned centering aperture, and means for dissipating heat generated at the front buffing surface of the buffing pad during use of the buffing pad assembly.

11. The buffing pad assembly according to claim 10, wherein the back-up pad has a non-circular configuration.

12. The buffing pad assembly according to claim 10, wherein the means for dissipating heat comprises a plurality of apertures extending through the buffing pad from the front buffing surface to the rear mounting surface.

13. The buffing pad assembly according to claim 12, wherein an upper end of the plurality of apertures is substantially unobstructed.

14. The buffing pad assembly according to claim 10, wherein the layer of fastening material on the rear mounting surface of the buffing pad is engageable with a layer of fastening material on the lower surface of the back-up pad.

15. The buffing pad assembly according to claim 14, wherein the layer of fastening material on the lower surface of the back-up pad has a non-circular configuration, and wherein the buffing pad assembly further comprises means for automatically aligning the layers of fastening material with one another.

16. The buffing pad assembly according to claim 15, further comprising a centering post projecting from and mounted on a top surface of the layer of fastening material on the rear mounting surface of the buffing pad, and a corresponding socket defined in the back-up pad.

17. A buffing pad assembly adapted for use with a buffing machine, the buffing pad assembly comprising:

a backing mount adapted to secure the buffing pad assembly to the buffing machine;

a back-up pad, having an upper and lower surface, secured at its upper surface to the backing mount;

a buffing pad, having a front buffing surface and a rear mounting surface surrounded by a raised annular centering lip, wherein the buffing pad is removably attached at its rear mounting surface to the lower surface of the back-up pad, and wherein the back-up pad has a non-circular configuration;

means for dissipating heat generated at the front buffing surface of the buffing pad during use of the buffing pad assembly;

a layer of fastening material on the rear mounting surface of the buffing pad, and a layer of fastening material on the lower surface of the back-up pad, wherein the layer of fastening material on the lower surface of the back-up pad has a non-circular configuration, and wherein the buffing pad assembly further comprises means for automatically aligning the layers of fastening material with one another.

18. The buffing pad assembly according to claim 17, wherein the back-up pad has a non-circular configuration.

19. The buffing pad assembly according to claim 17, wherein the means for dissipating heat comprises a plurality of apertures extending through the buffing pad from the front buffing surface to the rear mounting surface.

20. A buffing pad assembly adapted for use with a buffing machine, the buffing pad assembly comprising:

a backing mount adapted to secure the buffing pad assembly to the buffing machine;

a back-up pad having an upper and lower surface, secured at its upper surface to the backing mount;

a buffing pad, having a front buffing surface and a rear mounting surface surrounded by a raised annular centering lip, said buffing pad removably attached at its rear mounting surface to the lower surface of the back-up pad;

a plurality of apertures extending through the buffing pad from the front buffing surface to the rear mounting surface;

a layer of fastening material on the rear mounting surface of the buffing pad engageable with a layer of fastening material on the lower surface of the back-up pad; and a centering post projecting from and mounted on a top surface of the layer of fastening material on the rear mounting surface of the buffing pad, and a corresponding socket defined in the back-up pad.

21. The buffing pad assembly according to claim 20, wherein the back-up pad has a non-circular configuration.

22. The buffing pad assembly according to claim 20, wherein the buffing pad is made from reticulated polyurethane foam.

* * * * *